US010681445B2

(12) United States Patent
Hatfield et al.

(10) Patent No.: US 10,681,445 B2
(45) Date of Patent: Jun. 9, 2020

(54) EARPHONE ASSEMBLIES WITH WINGTIPS FOR ANCHORING TO A USER

(71) Applicant: Apple Inc., Cupertino, CA (US)

(72) Inventors: Dustin A. Hatfield, Los Gatos, CA (US); Christopher J. Stringer, Woodside, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/696,810

(22) Filed: Sep. 6, 2017

(65) Prior Publication Data

US 2018/0070165 A1 Mar. 8, 2018

Related U.S. Application Data

(60) Provisional application No. 62/384,124, filed on Sep. 6, 2016.

(51) Int. Cl.
*H04R 1/10* (2006.01)

(52) U.S. Cl.
CPC ..... *H04R 1/1016* (2013.01); *H04R 1/105* (2013.01); *H04R 1/1058* (2013.01); *H04R 1/1008* (2013.01); *H04R 1/1025* (2013.01); *H04R 1/1033* (2013.01); *H04R 2420/07* (2013.01); *H04R 2420/09* (2013.01)

(58) Field of Classification Search
CPC .... H04R 1/1016; H04R 1/105; H04R 1/1058; H04R 1/1066
USPC ..... 381/328, 380
See application file for complete search history.

(56) References Cited

U.S. PATENT DOCUMENTS

| | | | |
|---|---|---|---|
| 4,471,174 | A | 9/1984 | Nava |
| 4,993,065 | A | 2/1991 | Chiou |
| 5,412,736 | A | 5/1995 | Keliiliki |
| 5,519,782 | A | 5/1996 | Shinohara et al. |
| 5,581,622 | A | 12/1996 | Sakurai |
| 5,715,321 | A | 2/1998 | Andrea et al. |
| 5,927,659 | A | 7/1999 | Yang |

(Continued)

FOREIGN PATENT DOCUMENTS

| | | | |
|---|---|---|---|
| CN | 1857029 | A | 11/2006 |
| CN | 101411072 | A | 4/2009 |

(Continued)

OTHER PUBLICATIONS

PCT/US2016/048674 , "International Search Report and Written Opinion", dated Oct. 12, 2016, 10 pages.

(Continued)

*Primary Examiner* — Katherine A Faley
(74) *Attorney, Agent, or Firm* — Kilpatrick Townsend & Stockton LLP

(57) ABSTRACT

Earphone assemblies with wingtips are provided for anchoring to a user during use. A wing may extend from and between two different ends coupled to a housing of an earphone, while each of the at least one flex arm may extend along the wing. At least one flex arm may be rigid enough to prevent at least a portion of the wing from bending out of a plane of the wing such that a portion of the wing may maintain a functional position under and/or behind at least a portion of a crus of an anti-helix of a user's ear to anchor the earphone to the user's ear during use, while at least a portion of the wing may be flexible enough to provide comfort to the user's ear.

14 Claims, 9 Drawing Sheets

(56) References Cited

U.S. PATENT DOCUMENTS 7,720,234 B1 5/2010 Winslow et al.
8,121,325 B2 2/2012 Atamaniuk et al.
8,170,262 B1 5/2012 Liu
8,600,096 B2 12/2013 Lin
8,611,578 B2 12/2013 Kim et al.
8,655,004 B2 2/2014 Prest et al.
8,774,420 B2 7/2014 Belafonte et al.
8,774,435 B2 7/2014 Ambrose et al.
8,873,786 B2 10/2014 Larsen et al.
8,879,722 B1 11/2014 Wang et al.
8,897,480 B2 11/2014 Tan et al.
9,161,114 B2 10/2015 Bone et al.
9,344,792 B2 5/2016 Rundle
9,398,364 B2 7/2016 Monahan et al.
9,438,300 B1 9/2016 Oliaei
9,699,546 B2 7/2017 Qian et al.
10,021,474 B2 7/2018 Abreu
10,149,041 B2 12/2018 Qian et al.
2002/0041697 A1 4/2002 MacDonald et al.
2003/0003969 A1 1/2003 Tong et al.
2004/0028218 A1 2/2004 Rath et al.
2004/0096075 A1* 5/2004 Kuhlmann ..... A61F 11/00 381/312
2006/0093131 A1 5/2006 Cooper
2006/0227675 A1 10/2006 Fried
2006/0291685 A1 12/2006 Chou
2007/0036363 A1 2/2007 Hollemans et al.
2007/0036376 A1 2/2007 Fried
2007/0049361 A1 3/2007 Coote et al.
2007/0127757 A2 6/2007 Darbut et al.
2007/0258613 A1 11/2007 Wright
2008/0075316 A1 3/2008 Chan
2008/0107287 A1 5/2008 Beard
2008/0107301 A1 5/2008 Kim et al.
2008/0152183 A1 6/2008 Janik et al.
2008/0187164 A1 8/2008 Chou
2008/0220831 A1 9/2008 Alameh et al.
2008/0226114 A1 9/2008 Thompson et al.
2008/0298625 A1 12/2008 Prince
2008/0298626 A1 12/2008 Dean
2008/0310666 A1* 12/2008 Wengreen ..... H04R 1/026 381/381
2009/0010461 A1 1/2009 Klinghult et al.
2009/0041284 A1 2/2009 Tanaka et al.
2009/0067658 A1* 3/2009 Lin ..... H04R 1/2842 381/345
2009/0097689 A1 4/2009 Prest et al.
2009/0116666 A1 5/2009 Ranta
2009/0131124 A1 5/2009 Bibaud et al.
2009/0154739 A1 6/2009 Zellner
2009/0214073 A1 8/2009 Sandberg
2009/0215502 A1 8/2009 Griffin, Jr.
2010/0020998 A1 1/2010 Brown et al.
2010/0061581 A1 3/2010 Soetejo et al.
2010/0114188 A1 5/2010 Chan et al.
2010/0124349 A1 5/2010 Bass
2010/0183184 A1 7/2010 Milde et al.
2010/0217098 A1 8/2010 LeBoeuf et al.
2010/0217102 A1 8/2010 LeBoeuf et al.
2010/0320961 A1 12/2010 Castillo et al.
2011/0002498 A1 1/2011 Wong et al.
2011/0007929 A1 1/2011 Rabu et al.
2011/0066941 A1 3/2011 Chipchase et al.
2011/0110551 A1 5/2011 Ramsey
2011/0123059 A1 5/2011 Hu
2011/0129097 A1 6/2011 Andrea
2011/0158440 A1 6/2011 Mei et al.
2011/0176699 A1* 7/2011 Lin ..... H04R 1/1016 381/374
2011/0206215 A1 8/2011 Bunk
2011/0222719 A1 9/2011 Hagberg et al.
2011/0249854 A1 10/2011 Nystrêm Martin
2011/0261988 A1 10/2011 Kromann et al.
2012/0039500 A1 2/2012 Silvestri et al.
2012/0039501 A1 2/2012 Silvestri et al.
2012/0114132 A1 5/2012 Abrahamsson et al.
2012/0114154 A1 5/2012 Abrahamsson
2012/0207317 A1 8/2012 Milani et al.
2012/0224731 A1 9/2012 Zellner
2012/0243723 A1 9/2012 Halkosaari et al.
2013/0010997 A1* 1/2013 Tanaka ..... A61B 5/01 381/380
2013/0028446 A1 1/2013 Krzyzanowski
2013/0039509 A1 2/2013 Chuang et al.
2013/0083933 A1 4/2013 Aase
2013/0114842 A1 5/2013 Jennings
2013/0121494 A1 5/2013 Johnston
2013/0131519 A1 5/2013 Leboeuf et al.
2013/0177193 A1 7/2013 Orzel et al.
2013/0216087 A1 8/2013 MacDonald
2013/0236027 A1 9/2013 Tao et al.
2013/0279724 A1 10/2013 Stafford et al.
2013/0336495 A1 12/2013 Burgett et al.
2013/0343593 A1 12/2013 Howes et al.
2013/0343594 A1 12/2013 Howes et al.
2014/0016803 A1 1/2014 Puskarich
2014/0079240 A1 3/2014 Son
2014/0093091 A1 4/2014 Dusan et al.
2014/0093093 A1 4/2014 Dusan et al.
2014/0146982 A1 5/2014 Pelosi
2014/0270231 A1 9/2014 Dusan et al.
2014/0288447 A1 9/2014 Luna et al.
2014/0334658 A1 11/2014 Wang et al.
2015/0023516 A1 1/2015 Rabii et al.
2015/0110320 A1 4/2015 Liu et al.
2015/0181337 A1 6/2015 Rodgers
2015/0195639 A1 7/2015 Azmi et al.
2015/0201271 A1 7/2015 Diethom et al.
2015/0245129 A1 8/2015 Dusan et al.
2015/0310846 A1 10/2015 Andersen et al.
2015/0325251 A1 11/2015 Dusan et al.
2015/0350762 A1 12/2015 Birger et al.
2015/0382100 A1 12/2015 Azmi et al.
2016/0050477 A1 2/2016 Ushakov
2016/0094899 A1 3/2016 Aumer et al.
2016/0182994 A1 6/2016 Korch-Haahr et al.
2016/0192039 A1 6/2016 Negi et al.
2016/0205475 A1 7/2016 Shanmugam et al.
2016/0217780 A1 7/2016 Cagdaser
2016/0241946 A1 8/2016 Monahan et al.
2016/0249141 A1 8/2016 Verdooner et al.
2016/0261147 A1 9/2016 Blum et al.
2016/0294225 A1 10/2016 Blum et al.
2016/0316285 A1 10/2016 Qian et al.
2016/0361020 A1 12/2016 LeBoeuf et al.
2016/0381448 A1 12/2016 Qian et al.
2017/0064427 A1 3/2017 Rich et al.
2017/0078780 A1 3/2017 Qian et al.
2017/0078781 A1 3/2017 Qian et al.
2017/0078785 A1 3/2017 Qian et al.
2017/0195770 A1 7/2017 Cheney et al.
2018/0070165 A1 3/2018 Hatfield et al.
2019/0116415 A1 4/2019 Qian et al.
2019/0288543 A1 9/2019 Castillo et al.

FOREIGN PATENT DOCUMENTS

CN 102378078 3/2012
CN 102860820 1/2013
CN 103929698 A 7/2014
CN 104202696 A 12/2014
CN 104202697 A 12/2014
CN 104509129 A 4/2015
CN 204408594 U 6/2015
CN 205081918 3/2016
CN 205142471 4/2016
CN 206472266 9/2017
KR 20060084375 A 7/2006
KR 10-2010-0001360 A 1/2010
KR 20130065518 A 6/2013
TW 201220861 A 5/2012

(56) References Cited

FOREIGN PATENT DOCUMENTS

| | | | |
|---|---|---|---|
| WO | 2014/116924 | A1 | 7/2014 |
| WO | 2017048476 | A1 | 3/2017 |

OTHER PUBLICATIONS

U.S. Appl. No. 14/856,298, "Restriction Requirement", dated Jul. 20, 2016, 5 pages.
U.S. Appl. No. 14/856,298, "Notice of Allowance", dated Feb. 27, 2017, 10 pages.
U.S. Appl. No. 14/856,344, "Notice of Allowance", dated Jan. 13, 2017, 8 pages.
U.S. Appl. No. 14/856,402, "Non-Final Office Action", dated Nov. 4, 2016, 15 pages.
U.S. Appl. No. 14/856,402, "Notice of Allowance", dated Mar. 14, 2017, 10 pages.
U.S. Appl. No. 14/856,298, "First Action Interview Pilot Program Pre-Interview Communication", Nov. 23, 2016, 4 pages.
U.S. Appl. No. 14/856,344, "First Action Interview Pilot Program Pre-Interview Communication", Nov. 9, 2016, 5 pages.
Non-Final Office Action issued in U.S. Appl. No. 16/206,720, dated Jun. 14, 2019 in 18 pages.
International Preliminary Report on Patentability issued in PCT Application No. PCT/US2017/050201, dated Mar. 21, 2019 in 10 pages.
International Search Report and Written Opinion issued in PCT Application No. PCT/US2017/050201, dated Jan. 12, 2017 in 11 pages.
Notice of Allowance for U.S. Patent Application No. 16/206,720 dated Oct. 1, 2019, 11 pages.

* cited by examiner

EARPHONE ASSEMBLIES WITH WINGTIPS FOR ANCHORING TO A USER

CROSS-REFERENCE TO RELATED APPLICATION(S)

This application claims the benefit of prior filed U.S. Provisional Patent Application No. 62/384,124, filed Sep. 6, 2016, which is hereby incorporated by reference herein in its entirety.

TECHNICAL FIELD

This can relate to earphone assemblies, including earphone assemblies with wingtips for anchoring to a user.

BACKGROUND OF THE DISCLOSURE

Earphone assemblies are often worn by users that are exercising or performing other activities. However, such active use often dislodges an earphone assembly from its functional position with respect to a user's ear.

SUMMARY OF THE DISCLOSURE

Earphone assemblies with wingtips are provided for anchoring to a user during use.

As an example, an earphone assembly to be worn by a user's ear includes a housing, an audio output component positioned at least partially within the housing, a flex arm extending from a flex free end to a flex housing end held at a housing flex arm location with respect to the housing, and a wing extending from a first wing housing end to a second wing housing end, wherein the flex arm extends along a portion of the wing, and wherein a material of the flex arm is more rigid than a material of the wing.

As another example, an assembly to be worn by a user's ear includes a housing, a sheath fitted about the housing, a wing extending between a first wing end coupled to a first wing platform of the sheath and a second wing end coupled to a second wing platform of the sheath, and a flex arm extending within a portion of the wing between the first wing end and the second wing end, wherein the flex arm is configured to prevent at least the portion of the wing from moving out of a wing plane, and wherein the flex arm is configured to enable at least the portion of the wing to move within the wing plane.

As yet another example, an assembly to be worn by a user's ear includes a housing, a sheath fitted about the housing, a first flex arm extending between a first flex arm portion of the sheath and a first flex free end, a second flex arm extending between a second flex arm portion of the sheath and a second flex free end, and a wing including a wing portion extending between the first flex free end and the second flex free end, wherein at least a portion of the wing portion is operative to maintain contact with the user's ear when the assembly is worn by the user's ear.

This Summary is provided only to summarize some example embodiments, so as to provide a basic understanding of some aspects of the subject matter described in this document. Accordingly, it will be appreciated that the features described in this Summary are only examples and should not be construed to narrow the scope or spirit of the subject matter described herein in any way. Unless otherwise stated, features described in the context of one example may be combined or used with features described in the context of one or more other examples. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters refer to like parts throughout, and in which.

DETAILED DESCRIPTION OF THE DISCLOSURE

Figure 1:
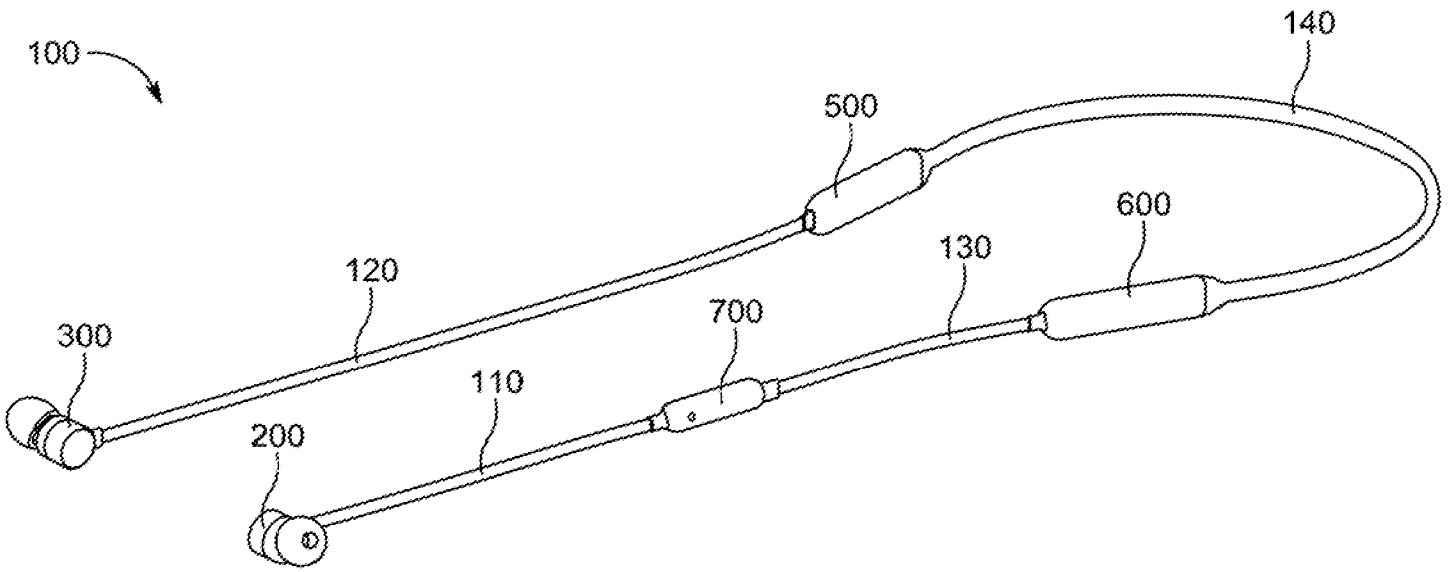
FIG. 1 is a perspective view of an illustrative earphone assembly that may be provided with at least one wingtip subassembly.
Figure 2:
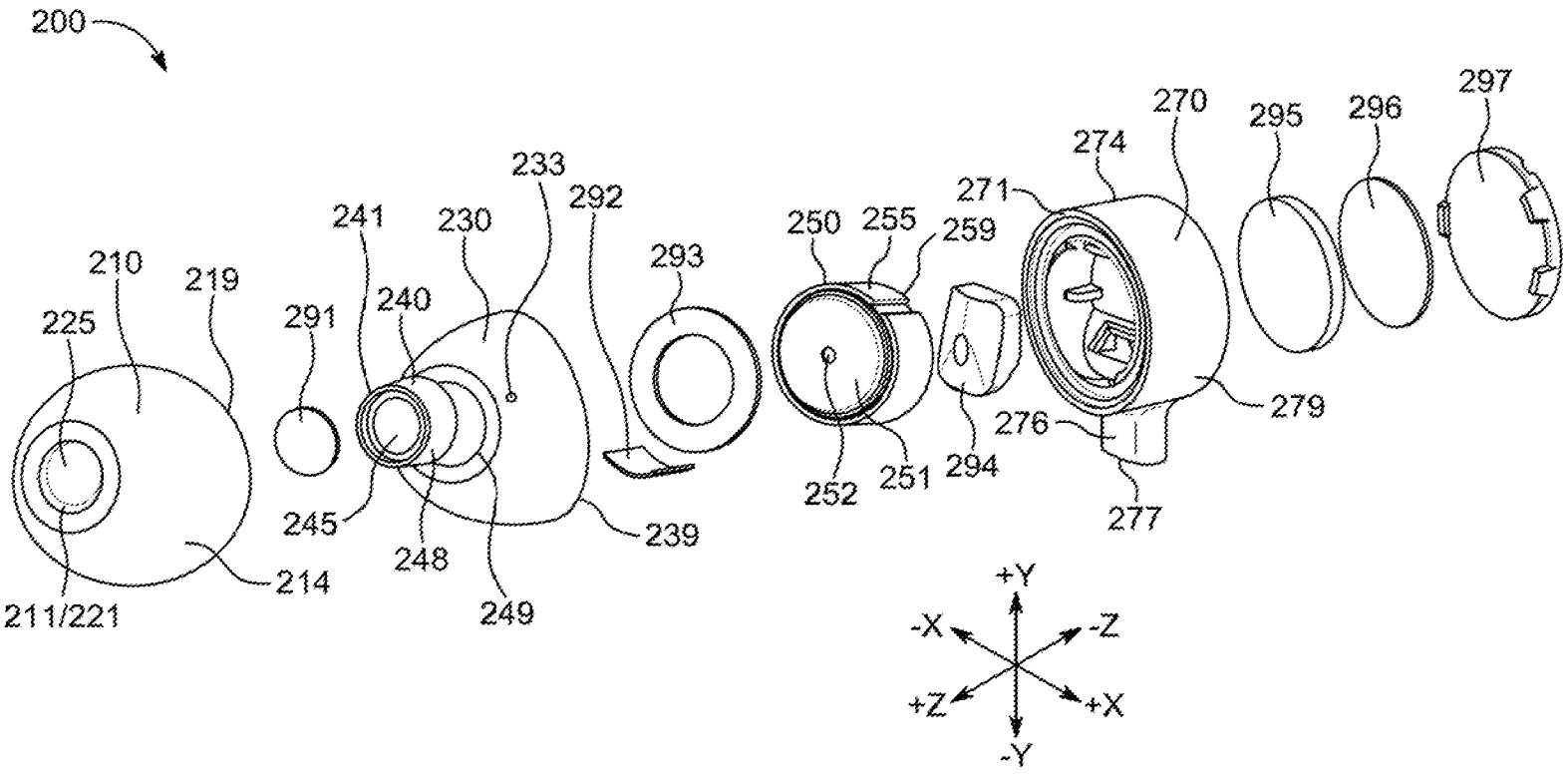
FIG. 2 is an exploded perspective view of an earbud subassembly of the earphone assembly of FIG. 1 without a wingtip subassembly.

Earphone assemblies with wingtips are provided and described with reference to FIGS. 1-9.

This disclosure describes a system to improve stability for earphones (e.g., wired or wireless in-ear earphones or for any other suitable type of earphones), particularly for active and sport use cases where the earphones can move and/or become dislodged, either ruining the sound quality or falling out completely from a functional position with respect to a user's ear. A housing of the earphone may house at least a portion of a sound emitting component of the earphone, and each of at least one flex arm may extend from the housing to a free end. A wing may extend from and between two different ends coupled to the housing, while each of the at least one flex arm may extend along the wing. At least one flex arm may be rigid enough to prevent at least a portion of the wing from bending out of a plane of the wing such that a portion of the wing may maintain a functional position under and/or behind at least a portion of a crus of an anti-helix of a user's ear to anchor the earphone to the user's ear during use, while at least a portion of the wing may be flexible enough to provide comfort to the user's ear.

Any suitable type of headphone or earphone assembly may be provided with one or more wingtips for anchoring to a user during use. For example, wingtips may be provided for an occluding earphone assembly that may include one or more occluding earbuds or earphones configured to be at least partially inserted into an ear canal of a user (e.g., an in-ear headphone or in-ear monitor or canalphone assembly) (see, e.g., earbud subassembly 200 and/or earbud subassembly 300 of earphone assembly 100 of FIGS. 1-3 and 5-8). Alternatively, wingtips may be provided for a non-occluding earphone assembly that may include one or more non-occluding earbuds or earphones configured not to be at least partially inserted into the ear canal of the user but that may fit directly in the outer ear (e.g., within a concha of the ear) and face the ear canal (see, e.g., earbud subassembly 930 and/or earbud subassembly 940 of earphone assembly 900 of FIG. 9). A wingtip may be removably coupled to an earbud of an earphone assembly, such that the wingtip may only be used when desired and/or such that different wingtips of different sizes may be interchangeably coupled to an earbud of an earphone assembly based on the size of the user's ear. Alternatively, a wingtip may be an integral part of an earphone assembly, such as a wingtip that is molded to or otherwise fixed to an earbud or other portion of the earphone assembly.

As shown in FIG. 1, an earphone assembly 100 that may be provided with one or more wingtip subassemblies may include a first earbud subassembly 200, a second earbud subassembly 300, a power supply subassembly 500, a logic subassembly 600, an input subassembly 700, and various cable subassemblies that may electrically couple the other subassemblies of earphone assembly 100, such as a first cable subassembly 110 that may electrically couple earbud subassembly 200 with input subassembly 700, a second cable subassembly 120 that may electrically couple earbud subassembly 300 with power supply subassembly 500, a third cable subassembly 130 that may electrically couple input subassembly 700 with logic subassembly 600, and a fourth cable subassembly 140 that may electrically couple power supply subassembly 500 with logic subassembly 600. Each one of first earbud subassembly 200 and second earbud subassembly 300 may be operative to receive audio data electrical signals (e.g., from cable subassembly 110 and cable subassembly 120, respectively), to convert or transduce the received electrical signals into corresponding sound waves, and to emit the sound waves towards an eardrum of a user wearing the earbud subassembly. First earbud subassembly 200 and second earbud subassembly 300 may be substantially the same in function, shape, and/or size, but may be mirror images of one another, such that each may be configured for comfortable use within a respective one of a user's left and right ears, where, for example, first earbud subassembly 200 may be configured for use in a user's left ear and second earbud subassembly 300 may be configured for use in a user's right ear. Power supply or battery subassembly 500 may include a battery or any other suitable power supply operative to receive and store power that may then be used to power various other subassemblies of assembly 100, where such power may be shared with one or more of subassemblies 200, 300, 600, and/or 700 via one or more of cable subassemblies 110, 120, 130, and/or 140. The power supply may be rechargeable via a charging port of assembly 100 (e.g., a charging port of power supply subassembly 500 and/or of logic subassembly 600) and/or may be replaceable. Power supply subassembly 500 may include a power button that may be used to turn assembly 100 on and off. Logic or main logic board ("MLB") subassembly 600 may include any suitable components for controlling the functionality of assembly 100, such as, but not limited to, a processor component, a memory component, a wireless communication component for receiving audio data information from a media player or radio source, a wired connector for connecting via a cable with a media player (not shown), a media player application if no remote media source is to be used, a charging port for the power supply of power supply assembly 500, and/or the like, each of which may be at least partially provided on an MLB. Input or user communication box subassembly 700 may include any suitable components for receiving user input commands for controlling assembly 100, such as, but not limited to, a microphone, one or more buttons that may be configured to receive user input for controlling volume and/or media selection, and/or the like. In some embodiments, assembly 100 may include other components not combined or included in those shown or several instances of the components shown.

As shown in one or more of FIGS. 2-8, earbud subassembly (hereinafter "earbud") 200 may include various components for receiving and transducing audio data electrical signals into corresponding sound waves as well as various components for maintaining a functional position within a user's outer ear and emitting the sound waves towards an eardrum of a user when worn by the user in the functional position. For example, earbud 200 may include an eartip 210, a front housing 230, a sound emitting subassembly or driver or transducer 250, a rear housing 270, and a wingtip subassembly 400. Front housing 230 and rear housing 270 may be operative to be coupled to one another to define an interior housing space within which at least a portion of sound emitting subassembly 250 may be held. An adhesive and/or mechanical snap-fit features and/or any other suitable coupling technique(s) may be used to hold front housing 230 and rear housing 270 together (e.g., to hold rear face 239 of front housing 230 to front face 271 of rear housing 270) and/or to hold sound emitting subassembly 250 to one or both of front housing 230 and rear housing 270. Earbud 200 may include a transducer adhesive 293 that may be operative to adhere to both a front face 251 of sound emitting subassembly 250 and to a rear face of front housing 230. Moreover, front housing 230 and rear housing 270 may be operative to communicatively couple a portion of front face 251 of sound emitting subassembly 250 to an inner eartip space 225 extending between a rear end opening 229 and a front end opening 221 of an inner eartip member 220 of eartip 210. For example, when held between front housing 230 and rear housing 270, an audio opening 252 provided through front face 251 of sound emitting subassembly 250 for emitting sound waves from sound emitting subassembly 250 (e.g., from a diaphragm and/or membrane of subassembly 250) may be communicatively aligned with a sound axis S that may also be aligned with an inner nozzle space 245 extending between a rear end opening 249 and a front end opening 241 of a nozzle member 240 of front housing 230 and that also may be aligned with inner eartip space 225 of inner eartip member 220. One or more mating features 228 along an outer surface of inner eartip member 220 may be operative to removably or fixedly mate with one or more mating features 248 along an inner surface of nozzle member 240 for communicatively coupling inner eartip space 225 defined by inner eartip member 220 of eartip 210 with inner nozzle space 245 defined by nozzle member 240 of front housing 230, such that sound waves emitted from sound emitting subassembly 250 (e.g., from audio opening 252) may be carried along a sound path (e.g., in the +S direction along sound axis S) through rear end opening 249 of nozzle member 240, along both inner nozzle space 245 and inner eartip space 225, and then out from front end opening 221 of inner eartip member 220 of eartip 210. Any suitable filter or mesh 291 may be provided along or across the sound path, such as over front end opening 241 of nozzle member 240, for enabling sound to pass therethrough and out from eartip 210 while preventing debris (e.g., dust and/or liquids) to pass therethrough and into inner nozzle space 245.

Eartip 210 may be operative to provide a comfortable fit for earbud 200 at least partially within an ear canal of a user and/or to form an acoustic seal between earbud 200 and the ear canal and/or to pass sound through the ear canal via front end opening 221 when earphone assembly 100 is worn by the user. For example, an external eartip structure 214 of eartip 210 may extend from a front end opening 211 (e.g., at front end opening 221 of inner eartip member 220) rearwards to a rear end opening 219 that may surround a portion of front housing 230 (e.g., nozzle member 240) to define an outer eartip space 215 between an internal surface of external eartip structure 214 and an external surface of inner eartip member 220, such that external eartip structure 214 may be deformable to fit within any suitable portion of a user's ear, such as an ear canal for forming the acoustic seal between earbud 200 and the user's ear. A front vent opening 233 may be provided through front housing 230 for enabling pressure relief of a front chamber 253 that may be defined by a space between front face 251 of sound emitting subassembly 250 and a portion of front housing 230 and a portion of eartip 210 and that may channel sound emitted from audio opening 252 of sound emitting subassembly 250 through front end opening 211/221 of eartip 210. Front vent opening 233 may be positioned so as not be covered or otherwise blocked by external eartip structure 214 or any other portion of eartip 210 when earbud 200 is held by a user's ear. A rear vent opening 237 may be provided through front housing 230 for enabling pressure relief of a rear chamber 257 that may be defined by a space between a side face 255 and/or a rear face 259 of sound emitting subassembly 250 and a portion of front housing 230 and a portion of rear housing 270. Any suitable filter or mesh 292 may be provided along the pressure relief path of rear vent opening 237, such as over opening 237 and against an internal surface of front housing 230 between front housing 230 and sound emitting subassembly 250, for enabling sound or other suitable air to pass therethrough and out from rear chamber 257 via opening 237 while preventing debris (e.g., dust and/or liquids) to pass therethrough and into rear chamber 257.

Rear housing 270 may include a cable opening 277 through which a portion of cable subassembly 110 may pass, such that an end of one or more conductors at an end of cable subassembly 110 (not shown) may be positioned within earbud 200 (e.g., within rear chamber 257 defined by rear housing 270) in order to be electrically coupled to one or more respective contacts of sound emitting subassembly 250. For example, as shown, cable opening 277 may be provided at a bottom end of a cable external strain relief structure 276 of rear housing 270 that may extend from a side structure 274 of rear housing 270 extending between front face 271 and rear face 279 of rear housing 270. Earbud 200 may also include an internal strain relief structure 294 that may be coupled to rear housing 270 for protecting at least a portion of the physical coupling between cable subassembly 110 and earbud 200 (e.g., to provide additional strain relief to that connection). A magnet 295 may be positioned against rear face 279 of rear housing 270 by any suitable mechanism(s), such as by an adhesive 296, and/or by a rear plate 297 that may be coupled to rear face 279 of rear housing 270. A complimentary magnet may be provided at a similar position on earbud 300, such that the magnets may magnetically hold earbud 200 and earbud 300 together when they are not in use (e.g., when earbuds 200 and 300 are not positioned within a user's ears), which may prevent the cable subassemblies of earphone assembly 100 from becoming tangled and/or may keep earphone assembly 100 compact.

Figure 3:
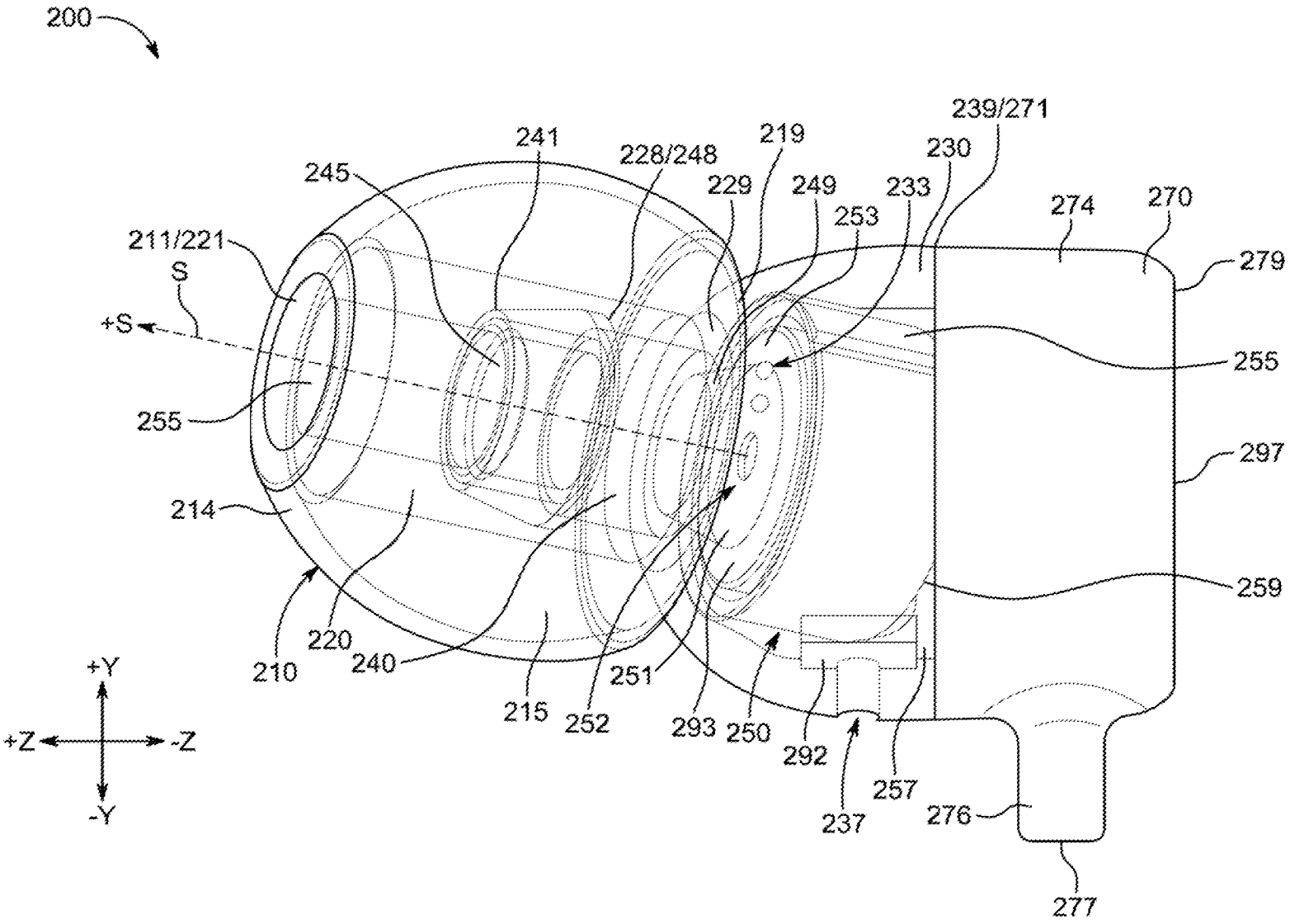
FIG. 3 is a side elevational view of the earbud subassembly of FIGS. 1 and 2 without a wingtip subassembly and with portions of the earbud subassembly partially transparent.
Figure 4:
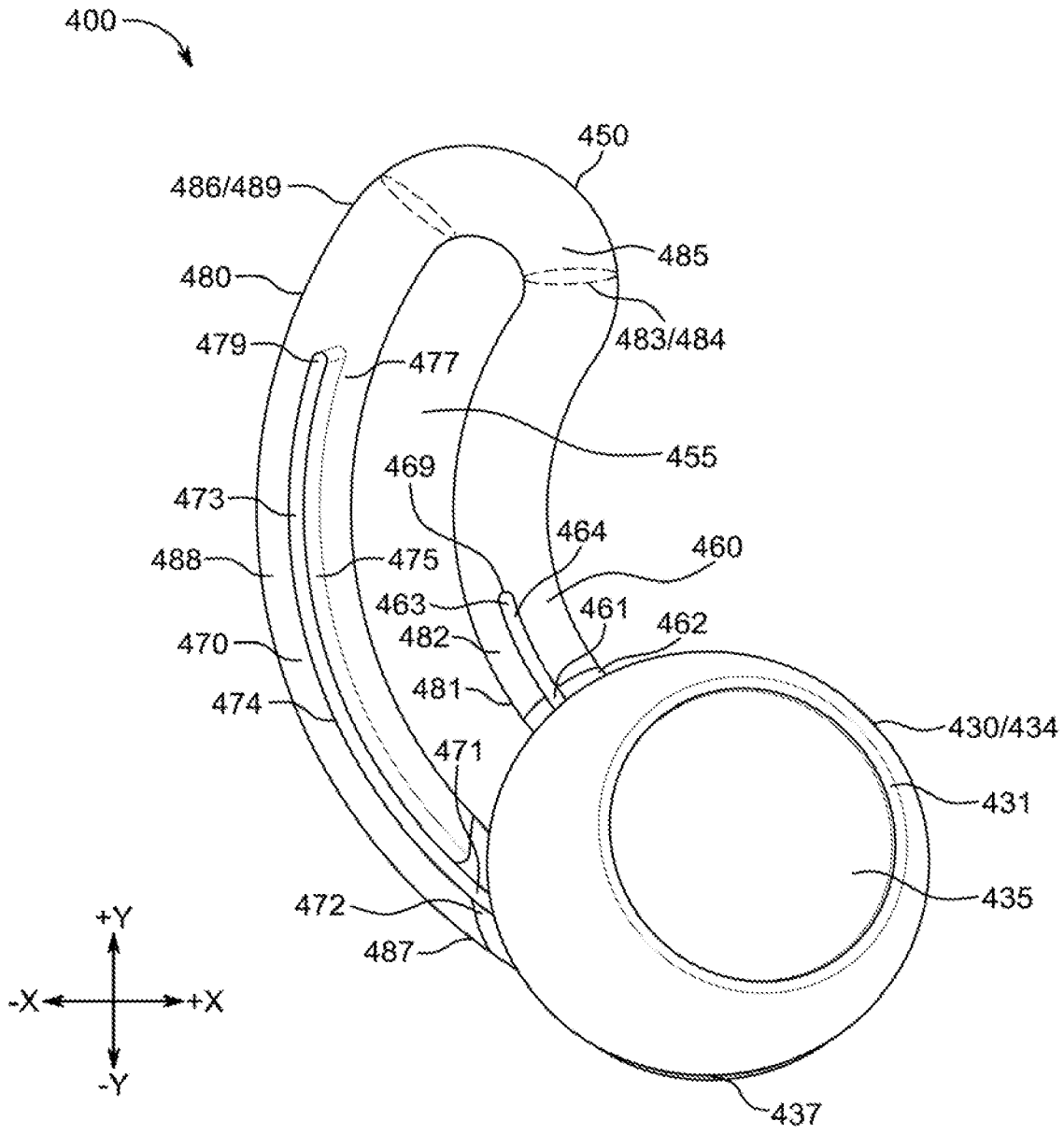
FIG. 4 is a front elevational view of a wingtip subassembly for the earbud subassembly of FIGS. 1-3.
Figure 5:
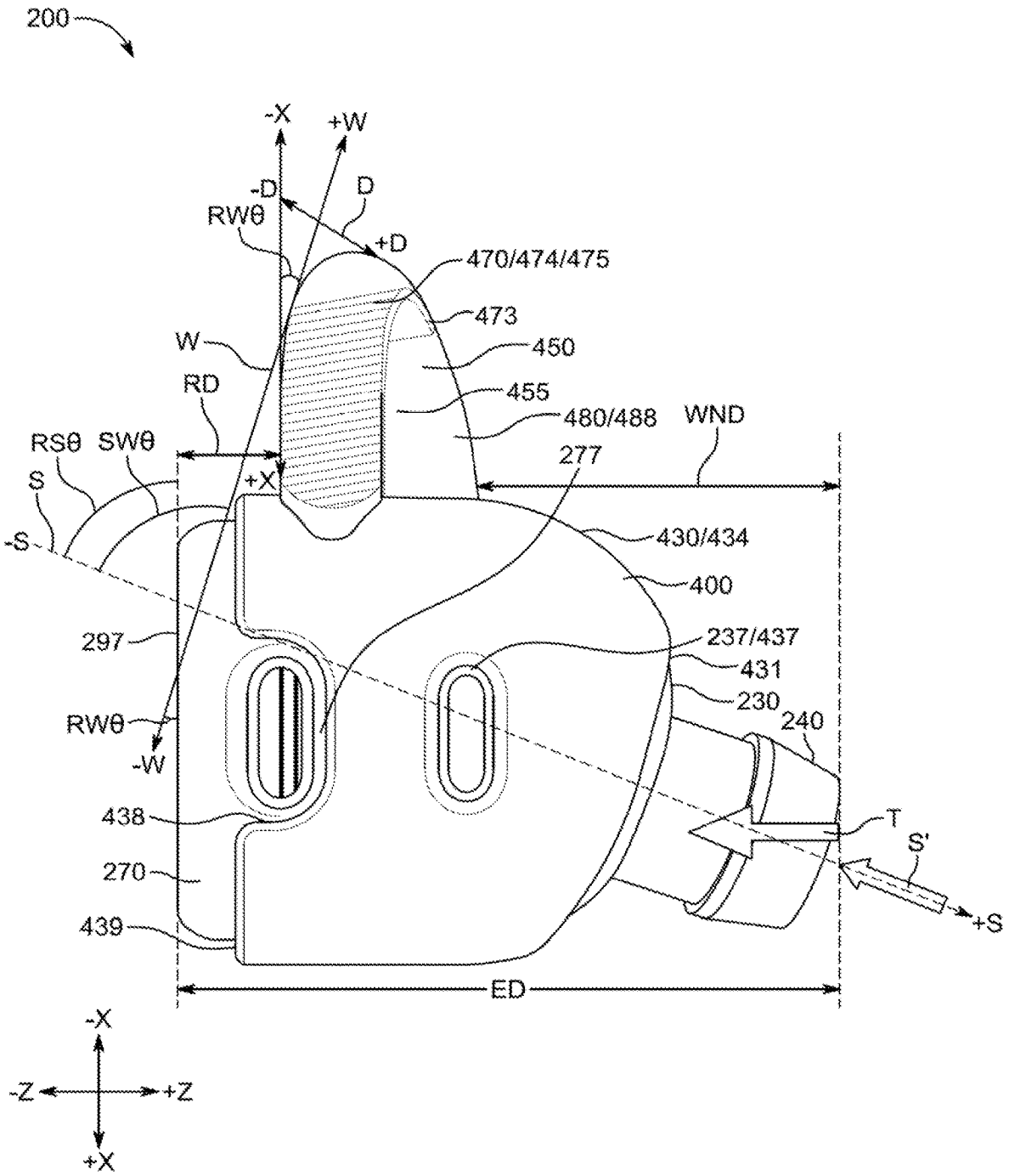
FIG. 5 is a bottom elevational view of the earbud subassembly of FIGS. 1-3 with the wingtip subassembly of FIG. 4.
Figure 6:
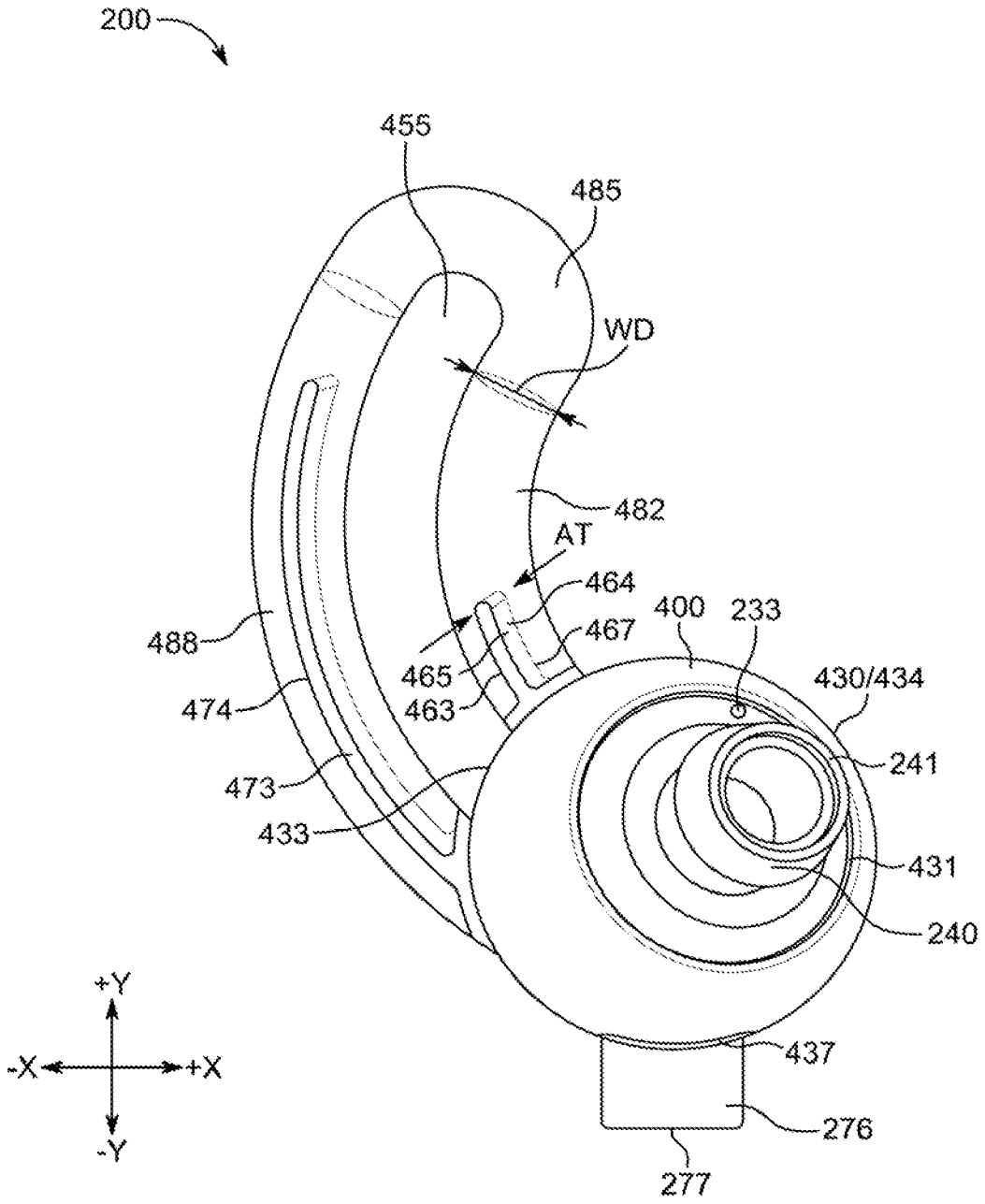
FIG. 6 is a front elevational view of the earbud subassembly of FIGS. 1-3 and 5 with the wingtip subassembly of FIGS. 4 and 5.
Figure 7:
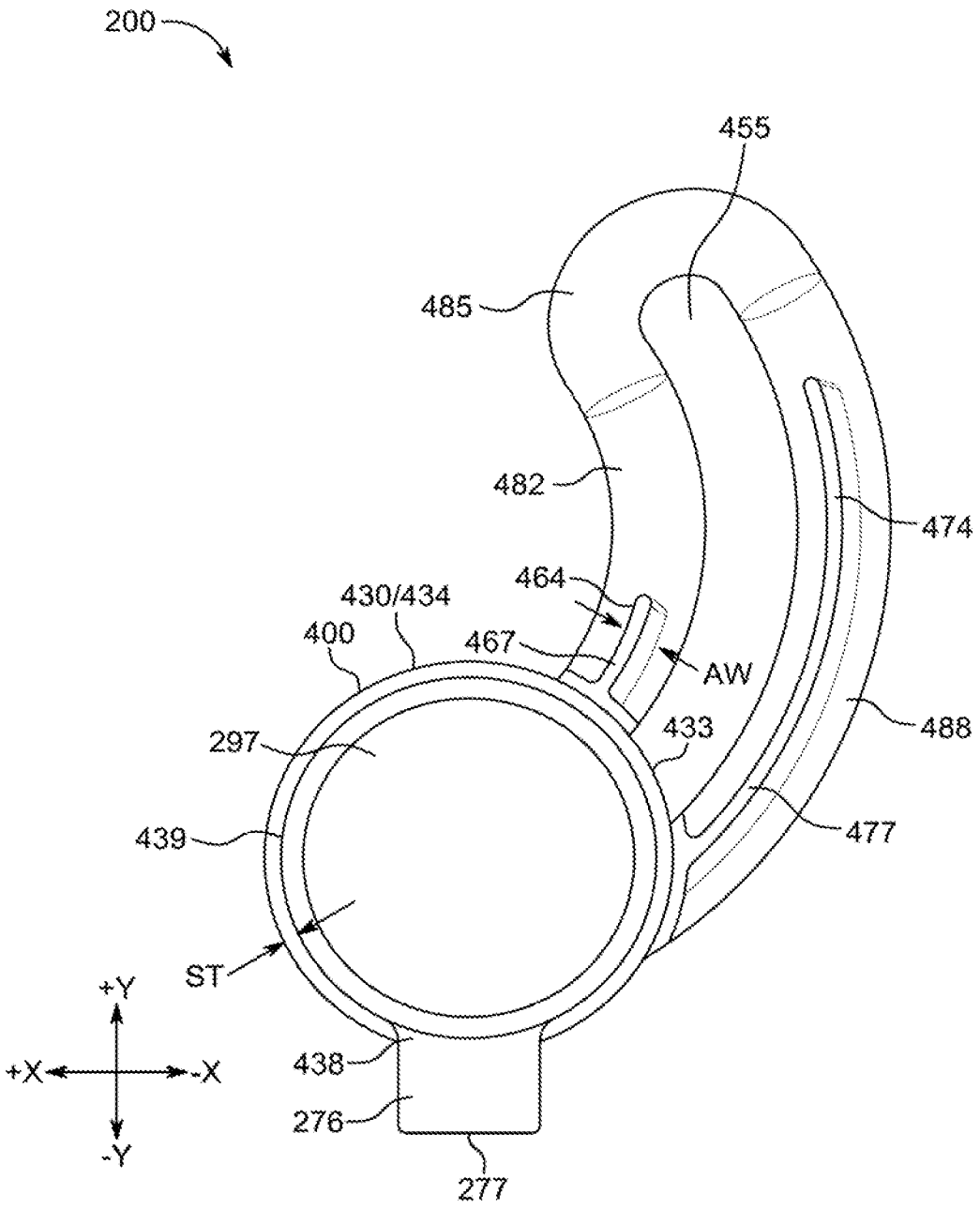
FIG. 7 is a rear elevational view of the earbud subassembly of FIGS. 1-3, 5, and 6 with the wingtip subassembly of FIGS. 4-6.

As shown in FIGS. 4-8, wingtip subassembly (hereinafter "wingtip") 400 of earbud assembly 200 may include various components for comfortably maintaining a functional position of earbud assembly 200 within a user's outer ear during use. For example, wingtip 400 may include a housing sheath 430 and a wing subassembly 450 extending from sheath 430. Sheath 430 may include a sheath structure 434 that may extend from a front end opening 431 to a rear end opening 439 for defining an interior sheath space 435, such that sheath 430 may be deformed or otherwise manipulated to be fitted about front housing 230 and/or rear housing 270 (e.g., such that at least a portion of front housing 230 and/or at least a portion of rear housing 270 may be positioned and held within interior sheath space 435). For example, once front housing 230 and rear housing 270 have been coupled to one another about sound emitting subassembly 250 (e.g., as shown in FIG. 3), but before eartip 210 has been coupled to nozzle member 240 of front housing 230 or once eartip 210 has been removed from nozzle member 240 of front housing 230 (e.g., as shown in FIGS. 5 and 6), sheath 430 may be operative to be fitted over a portion of front housing 230 and/or rear housing 270. As shown in FIG. 5, rear end opening 439 may lead sheath structure 434 of sheath 430 first in the direction of arrow S' (e.g., in the −S direction along sound axis S of nozzle member 240) about nozzle member 240 and then further in the direction of arrow T (e.g., rearward in the −Z direction) about a rear portion of front housing 230 and/or about a front portion of rear housing 270 (e.g., sheath structure 434 may be used to removably couple wingtip subassembly 400 to housings 230/270). In some embodiments, when fitted, sheath structure 434 may be operative to cover (e.g., hide at least a portion or the entirety of) any seam that may exist between front housing 230 and rear housing 270 (e.g., a coupling between rear end 239 of front housing 230 and front end 271 of rear housing 270).

Sheath structure 434 may include a notch 438 that may be aligned with (e.g., positioned at least partially about) cable external strain relief structure 276 and/or cable opening 277 of rear housing 270 when sheath structure 434 is properly fitted about rear housing 270 to help align sheath structure 434 with rear housing 270 and/or to help prevent sheath structure 434 from being dislodged from its appropriate position with respect to rear housing 270 (e.g., to prevent sheath structure 434 from rotating about the Z-axis and/or to prevent structure 434 from traveling further laterally along the −Z direction (e.g., along the direction of arrow T)). Additionally or alternatively, sheath structure 434 may include an opening 437 that may be aligned with (e.g., positioned at least partially about) rear vent opening 237 when sheath structure 434 is properly fitted about front housing 230 and/or rear housing 270, such that vent opening 237 may not be blocked by sheath structure 434 but instead may be enabled to relieve pressure via opening 237 of sheath structure 434 when wingtip 400 is in use. A raised lip portion of front housing 230 about rear vent opening 237 may be operative to extend outwardly away from front housing 230 (e.g., in the −Y direction (e.g., similarly to strain relief structure 276 of rear housing 270)) through opening 437 of sheath structure 434 to help align sheath structure 434 with front housing 230 and/or to help prevent sheath structure 434 from being dislodged from its appropriate position with respect to front housing 230 (e.g., to prevent sheath structure 434 from rotating about the Z-axis and/or to prevent structure 434 from traveling laterally along the Z-axis). Therefore, interaction between sheath notch 438 and rear housing 270 (e.g., strain relief structure 276) and/or interaction between sheath opening 437 and front housing 230 (e.g., rear vent opening 237) may be operative to key sheath structure 434 of wingtip subassembly 400 to the housing subassemblies of earbud subassembly 200 when being fitted thereon. The undeformed state (e.g., resting and/or natural state) of structure 434 may be configured to define interior sheath space 435 with a size that is the same or slightly smaller than the space occupied by the portion of front housing 230 and rear housing 270 to be fitted with structure 434, such that a tight fit may be provided between the housings and structure 434. However, at least a portion of structure 434 about notch 438 may be rigid enough to interact with strain relief structure 276 for maintaining a proper fitted position of structure 434 with respect to rear housing 270 (e.g., to prevent sheath structure 434 from rotating about the Z-axis and/or to prevent structure 434 from traveling further laterally along the −Z direction (e.g., along the direction of arrow T)). In some embodiments, as shown, when fitted on housing 230 and/or 270, sheath structure 434 may be configured not to block front vent opening 233 of front housing 230 (e.g., front end opening 431 may be fitted rearward of front vent opening 233). Alternatively, sheath structure 434 may include an opening operative to align with front vent opening 233 when sheath structure 434 is properly fitted, so as to enable front vent opening to function properly via such a sheath structure opening. Moreover, as shown, sheath structure 434 may be configured to have any suitable thickness ST, such as a thickness in a range between 0.3 millimeters and 0.7 millimeters or a thickness of 0.5 millimeters, such that the overall dimension of front housing 230 and/or rear housing 270 may not be increased more than 1 millimeter by fitting sheath structure 434 thereabout.

Wing subassembly 450 may include at least one flex arm, such as an anterior flex arm 460 and/or a posterior flex arm 470, that may extend away from sheath structure 434 through a respective wing arm of a unitary wing 480, such as an anterior wing arm 482 and a posterior wing arm 488 that may be coupled by a top wing portion 485 of wing 480. As shown, wing subassembly 450 may be operative to extend away from sheath structure 434 within any suitable W-X wing plane that may form any suitable rear wing angle RWθ with any suitable X-Y plane that may include rear plate 297 and/or that may include the portion of sheath structure 434 defining rear end opening 439. Rear wing angle RWθ may be any suitable angle, such as any angle in a range between 3° and 17° or an angle of 10° as may be shown in FIGS. 5-8 (e.g., a positive angle where the wing assembly may extend forwards towards front housing 230 with respect to rear housing 270). Alternatively, rear wing angle RWθ may be any suitable angle, such as any angle in a range between −3° and −17° or an angle of −10° (e.g., a negative angle where the wing assembly may extend rearwards from rear housing 270 and front housing 230). Alternatively, rear wing angle RWθ may be equal to 0°, such that the W-X wing plane may be parallel to or the same as an X-Y plane that may include rear plate 297 and/or that may include the portion of sheath structure 434 defining rear end opening 439. As also shown, an X-Y plane that may include rear plate 297 and/or that may include the portion of sheath structure 434 defining rear end opening 439 may form a rear sound angle RSθ with sound axis S (e.g., the axis along which nozzle member 240 may extend), where such a rear sound angle RSθ may be any suitable angle, such as any angle in a range between 47° and 87° or an angle of 67°. As also shown, a W-X wing plane within which wing subassembly 450 may be operative to extend away from sheath structure 434 may form a sound wing angle SWθ with sound axis S (e.g., the axis along which nozzle member 240 may extend), where such a sound wing angle SWθ may be any suitable angle, such as any angle in a range between 57° and 97° or an angle of 77°. In other embodiments, axis S may be perpendicular to rear face 279 such that rear sound angle RSθ may be 90°. In such embodiments, sound wing angle SWθ may be any suitable angle, such as any angle in a range between 80° and 120° or an angle of 100°.

Anterior flex arm 460 may include an anterior flex arm body 464 extending from an anterior flex sheath end 461 at sheath structure 434 to an anterior flex free end 469 (e.g., at a position along arm 482 between ends 481 and 483). Anterior flex body arm 464 may include a front anterior flex arm face 463, an opposite rear anterior flex arm face 467, and a side anterior flex arm face 465 extending between front anterior flex arm face 463 and rear anterior flex arm face 467 to define a thickness AT of anterior flex arm body 464 that may be consistent along at least the majority of if not the entirety of the length of anterior flex arm body 464. Additionally, flex arm body 464 may have a width AW that may be consistent along at least the majority of if not the entirety of the length of anterior flex arm body 464. In some embodiments, anterior flex arm 460 may also include an anterior flex platform 462 at and extending from sheath structure 434 about anterior flex sheath end 461 and along a portion of the length of anterior flex arm body 464, where anterior flex platform 462 may be operative to reinforce the joint between anterior flex arm body 464 and sheath structure 434. Anterior wing arm 482 may be an anterior wing arm body extending from an anterior wing sheath end 481 at sheath structure 434 (or at a top of optional anterior flex platform 462) to an anterior wing top end 483. Anterior wing arm 482 may have any suitable cross-sectional shape, such as circular with a cross-sectional diameter WD, that may be consistent along at least the majority of if not the entirety of the length of anterior wing arm 482. In some embodiments, thickness AT of anterior flex arm body 464 may be substantially similar to cross-sectional diameter or thickness WD of anterior wing arm 482, such that each one of front anterior flex arm face 463 and opposite rear anterior flex arm face 467 may define a portion of the external surface of wing subassembly 450 along with anterior wing arm 482 (e.g., such that thickness AT of anterior flex arm body 464 may extend through the entirety of the thickness of anterior wing arm 482 for at least a portion of anterior flex arm body 464 (e.g., such that anterior flex arm body 464 may bisect at least a portion of anterior wing arm 482)). Width AW of flex arm body 464 may be any suitable magnitude, such as a magnitude in a range between 0.35 millimeters and 0.65 millimeters or a magnitude of 0.50 millimeters. One or each of thickness AT and thickness WD may be any suitable magnitude, such as a magnitude in a range between 2.0 millimeters and 3.6 millimeters or a magnitude of 2.8 millimeters. For example, the diameter WD or the entirety of wing 480 may be 2.8 millimeters and the thickness AT of flex arm body 464 may be 2.8 millimeters along its length. Alternatively, thickness AT of anterior flex arm body 464 may be smaller than cross-sectional diameter or thickness WD of anterior wing arm 482 such that anterior flex arm body 464 may be surrounded by anterior wing arm 482 for at least a portion of anterior flex arm body 464 (e.g., encompassing flex arm body 464) and such that the external surface of wing subassembly 450 may not be defined by at least that portion of anterior flex arm body 464 (e.g., anterior flex arm body 464 may extend completely within wing arm 482). In some embodiments, anterior flex platform 462 may have a cross-sectional shape that is the same as that of anterior wing arm 482 with cross-sectional diameter WD such that anterior wing arm 482 may extend directly away from the top of anterior flex platform 462 and such that the external surface of wing subassembly 450 across the junction of anterior wing arm 482 and anterior flex platform 462 may be smooth and continuous. Alternatively, anterior flex platform 462 may have a cross-sectional shape that is smaller than that of anterior wing arm 482 with cross-sectional diameter WD such that anterior wing arm 482 may extend about and along the length of anterior flex platform 462 all the way to sheath structure 434 (e.g., encompassing platform 462) such that the external surface of wing subassembly 450 may not be defined by platform 462. Anterior flex arm body 464 may extend along any suitable portion of the length of anterior wing arm 482 between anterior wing ends 481 and 483, such as in a range of 5% to 45% of the length of anterior wing arm 482 or about 25% of the length of anterior wing arm 482. In some embodiments, the length of anterior flex arm body 464 may be in a range of 2 millimeters to 6 millimeters or about 4 millimeters.

Posterior flex arm 470 may include a posterior flex arm body 474 extending from a posterior flex sheath end 471 at sheath structure 434 to a posterior flex free end 479 (e.g., at a position along arm 488 between ends 487 and 489). Posterior flex body arm 474 may include a front posterior flex arm face 473, an opposite rear posterior flex arm face 477, and a side posterior flex arm face 475 extending between front posterior flex arm face 473 and rear posterior flex arm face 477 to define a thickness of posterior flex arm body 474 that may be consistent along at least the majority of if not the entirety of the length of posterior flex arm body 474 (e.g., similar to thickness AT of anterior flex arm body 464). Additionally, flex arm body 474 may have a width that may be consistent along at least the majority of if not the entirety of the length of flex arm body 474 (e.g., similar to width AW of anterior flex arm body 464). In some embodiments, posterior flex arm 470 may also include a posterior flex platform 472 at and extending from sheath structure 434 about posterior flex sheath end 471 and along a portion of the length of posterior flex arm body 474, where posterior flex platform 472 may be operative to reinforce the joint between posterior flex arm body 474 and sheath structure 434 (e.g., with a height of about 0.5 millimeters or any other suitable height). Posterior wing arm 488 may be a posterior wing arm body extending from a posterior wing sheath end 487 at sheath structure 434 (or at a top of optional posterior flex platform 472) to a posterior wing top end 489. Posterior wing arm 488 may have any suitable cross-sectional shape, such as circular with a cross-sectional diameter, that may be consistent along at least the majority of if not the entirety of the length of posterior wing arm 488 (e.g., similar to diameter WD of anterior wing arm 482). In some embodiments, the thickness of posterior flex arm body 474 between front posterior flex arm face 473 and rear posterior flex arm face 477 may be substantially similar to the cross-sectional diameter of posterior wing arm 488, such that each one of front posterior flex arm face 473 and opposite rear posterior flex arm face 4767 may define a portion of the external surface of wing subassembly 450 along with posterior wing arm 488 (e.g., such that the thickness of posterior flex arm body 474 may extend through the entirety of the thickness of posterior wing arm 488 for at least a portion of posterior flex arm body 474 (e.g., such that posterior flex arm body 474 may bisect at least a portion of posterior wing arm 488)). Alternatively, the thickness of posterior flex arm body 474 may be smaller than the cross-sectional diameter of posterior wing arm 488 such that posterior flex arm body 474 may be surrounded by posterior wing arm 488 for at least a portion of posterior flex arm body 474 (e.g., encompassing flex arm body 474) and such that the external surface of wing subassembly 450 may not be defined by at least that portion of posterior flex arm body 474 (e.g., posterior flex arm body 474 may extend completely within wing arm 488). In some embodiments, posterior flex platform 472 may have a cross-sectional shape that is the same as that of posterior wing arm 488 such that posterior wing arm 488 may extend directly away from the top of posterior flex platform 472 and such that the external surface of wing subassembly 450 across the junction of posterior wing arm 488 and posterior flex platform 472 may be smooth and continuous. Alternatively, posterior flex platform 472 may have a cross-sectional shape that is smaller than that of posterior wing arm 488 such that posterior wing arm 488 may extend about and along the length of posterior flex platform 472 all the way to sheath structure 434 (e.g., encompassing platform 472) such that the external surface of wing subassembly 450 may not be defined by platform 472. Posterior flex arm body 474 may extend along any suitable portion of the length of posterior wing arm 488 between posterior wing ends 487 and 489, such as in a range of 45% to 100% of the length of posterior wing arm 488 or about 50% or 66% or 75% of the length of posterior wing arm 488. In some embodiments, the length of posterior flex arm body 474 may be in a range of 10 millimeters to 30 millimeters or about 20 millimeters. As the stability of wing 480 is provided by one or more of flex arms 460 and 470, there is no need for a significant amount of material to be provided at a joint between sheath structure 434 and/or housing 270 and wing 480, which may improve the comfortability of wearing assembly 200 within an ear.

Top wing portion 485 may be provided to couple anterior wing arm 482 to posterior wing arm 488 to form a unitary structure wing 480. For example, top wing portion 485 may extend from an anterior end 484 at anterior wing top end 483 of anterior wing arm 482 to a posterior end 486 at posterior wing top end 489 of posterior wing arm 488, such that a closed wing space 455 of wing subassembly 450 may be defined by unitary wing 480 and sheath structure 434 within a W-X wing plane. In some embodiments, as shown, each sheath end of wing subassembly 450 (e.g., platforms 462 and 472 and/or ends 481 and 487) may be distinct and not structurally coupled to one another by another portion of wing subassembly 450 extending along sheath structure 434 but only by a portion of sheath structure 434, whereby wing space 455 may be defined by at least a portion 433 of sheath structure 434. Alternatively, in some embodiments, platforms 462 and 472 may provide a unitary structure. One, some, or each one of wing arms 482 and 488 and top wing portion 485 of wing 480 may have a particular radius of curvature (e.g., within a W-X wing plane), where each radius of curvature may be the same as one another or different than one another. For example, a length along an inner periphery of wing 480 (e.g., defining a portion of space 455) may be defined by the length along the inner periphery between ends 481 and 483, which may be 10.9 millimeters, the length along the inner periphery between ends 484 and 486, which may be 1.5 millimeters, and the length along the inner periphery between ends 489 and 487, which may be 14.2 millimeters, and a length along an outer periphery of wing 480 may be defined by the length along the outer periphery between ends 481 and 483, which may be 8.1 millimeters, the length along the outer periphery between ends 484 and 486, which may be 4.3 millimeters, and the length along the outer periphery between ends 489 and 487, which may be 17.0 millimeters (e.g., whereby the length of the inner periphery plus the diameter of wing 480 (e.g., 2.8 millimeters) may equal the length of the outer periphery). In some embodiments, a length of wing 480 between ends 481 and 487 may be in a range between 20 millimeters and 40 millimeters or about 30 millimeters, while a length of posterior flex arm body 474 along wing 480 may be in a range between 5 millimeters and 20 millimeters or about 12 millimeters (e.g., in a range between 20% and 60% or about 40% of the length of wing 480), while a length of anterior flex arm body 464 along wing 480 may be in a range between 1 millimeters and 5 millimeters or about 3 millimeters (e.g., in a range between 1% and 20% or about 10% of the length of wing 480). The exterior surface of wing 480, which may include a portion of front anterior flex arm face 463 and/or rear anterior flex arm face 467 and/or front posterior flex arm face 473 and/or rear posterior flex arm face 477, may be polished before use by an end user such that the entire outer surface of wing 480 may be smooth and continuous and may have a circular or other smooth shape periphery at each cross-section along its length, to promote a comfortable experience for a user.

Any suitable materials and/or assembly processes may be used to provide wingtip subassembly 400. For example, in some embodiments, at least one or each of the one or more of flex arms 460 and 470 may be provided by a more rigid material than the material used to provide unitary wing 480. As one example, at least one or each of the one or more of flex arms 460 and 470 may be provided by a first material with a first hardness (e.g., first durometer (e.g., 85-95 or 90 Shore D durometer)), such as a relatively rigid nylon (e.g., TR90 nylon) (e.g., through a stereolithographic process or molding process), while unitary wing 480 may be provided by a second material with a second hardness (e.g., second durometer (e.g., 35-65 or 50 Shore A durometer)) that is less than the first hardness, such as silicone (e.g., through a stereolithographic process or molding process). While the less rigid and more flexible second material of wing 480 may provide for a more comfortable interaction with a user's ear and allow for additional manipulation along portions of wing 480 through which a flex arm does not extend (e.g., top wing portion 485), the more rigid and less flexible first material of the one or more of flex arms 460 and 470 may be operative to limit certain types of motion possible by wing subassembly 450 (e.g., when fitted within an ear of a user). For example, the rigidity of the structure of one or more of flex arms 460 and 470 may be configured to prevent wing arms 482 and 488 (or at least any other majority portion) of unitary wing 480 from laterally deflecting or rotating out from a W-X wing plane of wing subassembly 450, such as in a rearward −D direction and/or in a forward +D direction along a D-axis that may be perpendicular to a W-axis of the W-X wing plane of wing subassembly 450. Additionally, the rigidity of the structure of one or more of flex arms 460 and 470 may be configured to prevent wing arms 482 and 488 of unitary wing 480 from rotating about an axis within a W-X wing plane of wing subassembly 450 (e.g., torquing of wing arms 482 and 488 may be prevented by the structure of flex arm 460 and/or flex arm 470). Additionally, the rigidity of the structure of one or more of flex arms 460 and 470 may be configured to allow one or both of wing arms 482 and 488 of unitary wing 480 to bend within a W-X wing plane of wing subassembly 450, such as to allow wing arm 488 to bend towards wing arm 482 within the W-X wing plane of wing subassembly 450 and/or to allow wing arm 482 to bend towards wing arm 488 within the W-X wing plane of wing subassembly 450. As mentioned, while wing subassembly 450 is shown to include not only anterior flex arm 460 through anterior wing arm 482 but also posterior flex arm 470 through posterior wing arm 488, it is to be understood that only flex arm 460 but not flex arm 470 may be provided in certain other embodiments or that only flex arm 470 but not flex arm 460 may be provided in yet other embodiments. In any embodiment, the rigidity of the structure of one or more of flex arms 460 and 470 may be operative to limit certain types of motion possible by wing subassembly 450 (e.g., when fitted within an ear of a user to anchor earbud subassembly 200 to the ear during use of earbud subassembly 200).

Figure 8:
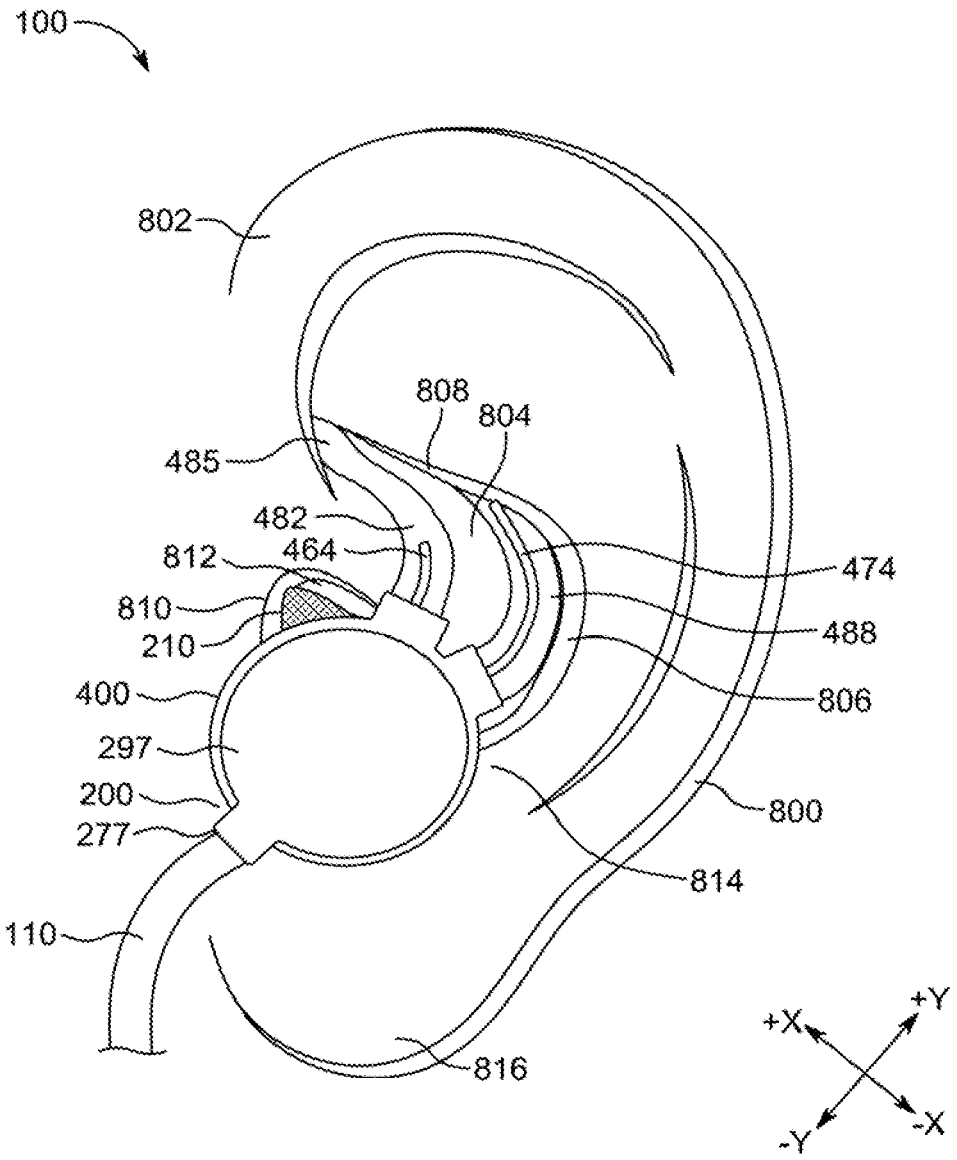
FIG. 8 is a rear elevational view of the earbud subassembly of FIGS. 1-3 and 5-7 with the wingtip subassembly of FIGS. 4-7 anchored to an ear of a user.

As shown in FIG. 8, wingtip subassembly 400 of earbud subassembly 200 may be operative to anchor earbud subassembly 200 to an ear 800 of a user during use, where ear 800 may include a helix 802, a concha 804, an anti-helix 806, an anti-helix crus 808, a tragus 810, an ear canal 812, an anti-tragus 814, and a lobe 816. As shown, the length of posterior flex arm body 474 of posterior flex arm 470 may be long enough to provide stability to wing 480 all the way up to the portion of wing 480 at anti-helix crus 808, where end 479 of posterior flex arm body 474 may be positioned under and/or behind at least a portion of anti-helix crus 808 or may be positioned just below anti-helix crus 808 such that only wing 480 (e.g., top wing portion 485) but not portion of any flex arm may be positioned under and/or behind at least a portion of anti-helix crus 808. In any event, posterior flex arm body 474 and/or anterior flex arm body 464 may provide enough stability to the entirety of wing 480 to prevent wing 480 from deflecting or rotating out from the W-X wing plane of wing subassembly 450, a portion of which may be positioned under anti-helix crus 808, thereby maintaining the functional position of wing 480 with respect to ear 800 of FIG. 8, which may also include at least a portion of eartip 210 positioned within ear canal 812. Therefore, a rigidity of posterior flex arm 470 may be operative to distribute a load that may be applied to wingtip 400 by ear 800 to promote comfortability. As shown in FIG. 8, in some embodiments, posterior wing arm 488 may be operative to extend along at least a portion of anti-helix 806 (e.g., up to anti-helix crus 808 before another portion of posterior wing arm 488 or top wing portion 485 may extend under anti-helix crus 808).

Different sized versions of wingtip subassembly 400 may be provided for use by a user on earbud subassembly 200 (e.g., based on the size of ear 800). For example, different wingtips 400 may be provided with a notch 438 of different sizes (e.g., different notches 438 may have different depths along the Z-axis) which may vary a distance RD between rear end 439 of each sheath structure 434 and rear end plate 297 coupled to rear housing 270 when each sheath structure 434 may be fitted on housings 230/270. Therefore, while an earbud distance ED between rear end plate 297 and front end 241 of nozzle member 240 may be fixed for a particular earbud assembly 200, varying distance RD between rear end 439 of sheath structure 434 and rear end plate 297 (e.g., by varying the depth of notch 438 between different sized wingtips 400) may vary a wingtip nozzle distance WND between wing 480 and front end 241 of nozzle member 240, which may account for at least a portion of a difference in size between two different ears (e.g., a longer magnitude of distance WND may provide a more comfortable fit within a larger ear). Additionally or alternatively, a length of wing 480 (e.g., from sheath structure 434 to top wing portion 485) may be varied between wingtips 400, which may account for at least a portion of a difference in size between two different ears.

The first material or material combination that may be used to provide at least one or each of the one or more of flex arms 460 and 470 may also be used to provide at least a portion of at least one or each of the one or more of flex platforms 462 and 472. The first material or material combination that may be used to provide at least one or each of the one or more of flex arms 460 and 470 may also be used to provide at least a portion of sheath structure 434, such as at least one or each of the portions of sheath structure 434 at which which flex arm 460 and/or flex platform 462 and/or flex arm 470 and/or flex platform 472 may be coupled to sheath structure 434. The first material or material combination that may be used to provide at least one or each of the one or more of flex arms 460 and 470 may also be used to provide the entirety of sheath structure 434 or at least the portion of sheath structure rearward of sheath structure opening 437 to help prevent rotation of sheath structure 434 with respect to rear housing 270 (e.g., about the Z-axis). In some embodiments, at least a portion or the entirety of sheath structure 434 may be molded during a first single shot molding process that also includes molding each of the one or more of flex arms 460 and 470 and each of any of platforms 462 and 472, such as using the first material or first material combination. Then, wing 480 may be molded onto sheath structure 434 and/or each of the one or more of flex arms 460 and 470 and each of any of platforms 462 and 472 during a second single shot molding process, such as using a second material or second material combination that is less rigid or more flexible than the first material or first material combination of the first single shot molding process. In some embodiments, if only a first (e.g., a rear portion) of sheath structure 434 may be formed during the first single shot molding process, the remainder or at least another portion (e.g., a front portion) of sheath structure 434 may be formed during the second single shot molding process or during a third single shot molding process that may use at least one material different than that used in either the first or second shot molding processes. In some embodiments, at least a portion or the entirety of front housing 230 and/or at least a portion of eartip 210 and/or at least a portion of rear housing 270 may be formed as a portion of a unitary structure that may also include wingtip 400 (e.g., during the same first molding shot as may be used to form each of the one or more of flex arms 460 and 470 and each of any of platforms 462 and 472 and/or at least a portion of sheath structure 434, or during the same second molding shot as may be used to form at least a portion of wing 480, or during a third molding shot distinct from each of the first and second molding shots).

Figure 9:
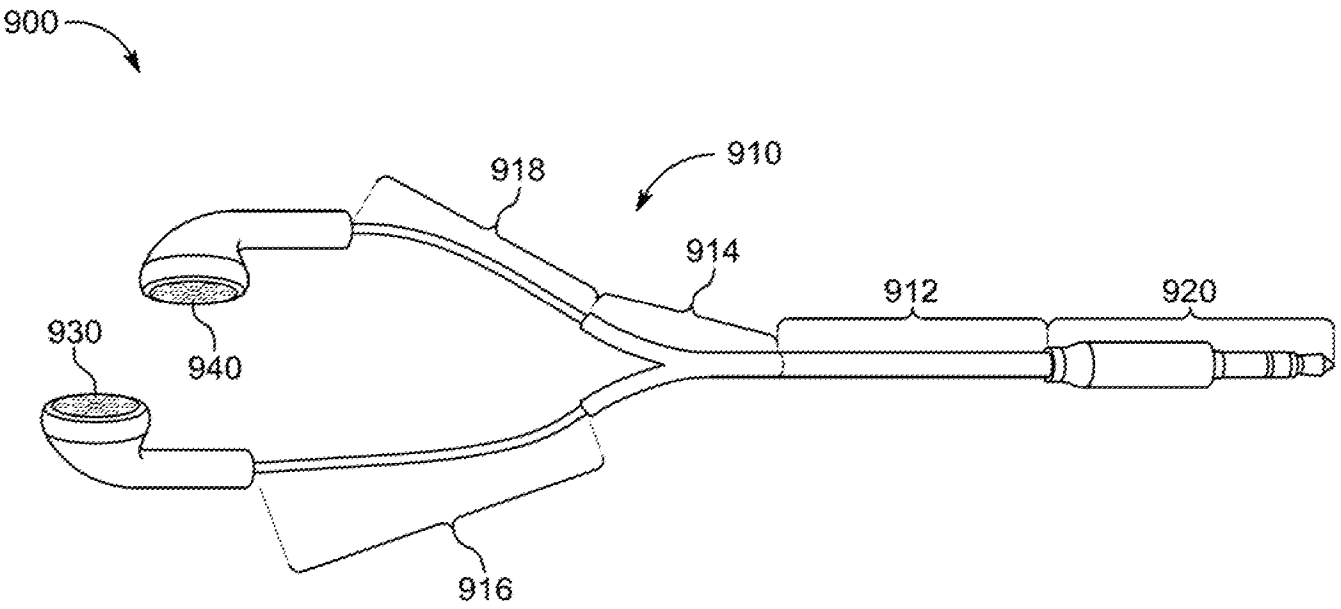
FIG. 9 is a perspective view of another illustrative earphone assembly that may be provided with at least one wingtip subassembly.

As mentioned, any suitable non-occluding earphone or headset assembly may be provided with wingtips for securing the assembly to a user. For example, as shown in FIG. 9, an earphone assembly 900 may include a cable 910 that can electrically couple an audio connector component 920 to a left speaker component or left earbud subassembly 930 and/or to a right speaker component or right earbud subassembly 940. Cable 910 may include a main region 912 that may extend between audio connector component 920 and a bifurcation (e.g., forked region) 914 of cable 910. Cable 910 may also include a left region 916 that may extend between bifurcation 914 and left earbud subassembly 930. Alternatively or additionally, cable 910 may include a right region 918 that may extend between bifurcation 914 and right earbud subassembly 940. Any one or more of cable regions 912, 914, 916, and 918 of cable 910 may include one or more conductors that may be configured to transmit data and/or power signals between audio connector component 920 and one or both of left earbud subassembly 930 and right earbud subassembly 940. Earphone assembly 900 may be configured to communicate any suitable data signals, such as audio signals, video signals, control signals, and the like with a media device. Connector component 920 may be operative to be physically coupled to any suitable connector of any suitable media device (not shown) for enabling wired communication between assembly 900 and such a media device. Alternatively, assembly 900 may not include a connector component 920 but may be operative to wirelessly communicate with such a media device. Wingtip 400 may be coupled to left earbud subassembly 930 to anchor subassembly 930 within ear 800 in a similar fashion, despite no eartip being positioned within ear canal 812.

While there have been described earphone assemblies with wingtips for anchoring to a user, it is to be understood that many changes may be made therein without departing from the spirit and scope of the disclosure. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Therefore, those skilled in the art will appreciate that the invention can be practiced by other than the described embodiments, which are presented for purposes of illustration rather than of limitation.

What is claimed is:

1. An earphone assembly to be worn by a user's ear, the earphone assembly comprising:

a housing having an audio port;

a speaker disposed within the housing and aligned to emit sound through the audio port;

a sheath removably coupled to the housing;

a deformable wing sized and shaped to anchor the earphone assembly to a user's ear and having first and second ends coupled to first and second anchoring locations, respectively, on the sheath;

a first flex arm body positioned within the deformable wing and extending from the first anchoring location and terminating at a location between the first and second ends; and a second flex arm body positioned within the deformable wing and extending from the second anchoring location and terminating at a location between a distal end of the first flex arm and the second end, wherein the first flex arm body has a length that is at least twice as long as a length of the second flex arm body and wherein a material of the first and second flex arm bodies is more rigid than a material of the deformable wing.

2. The earphone assembly of claim 1, wherein the first anchoring location is different than the second anchoring location.

3. The earphone assembly of claim 1, wherein a length of the first flex arm body comprises between 20% and 60% of a length of the deformable wing; and a length of the second flex arm body comprises between 1% and 20% of the length of the deformable wing.

4. The earphone assembly of claim 1, wherein the first flex arm body and the second flex arm body extend along distinct portions of the length of the deformable wing.

5. The earphone assembly of claim 1, wherein the first and second flex arm bodies exist within a wing plane; and the first and second flex arm bodies are configured to prevent at least a majority of the wing from moving out from the wing plane.

6. The earphone assembly of claim 5, wherein the first and second flex arm bodies are configured to enable at least a portion of the wing to bend within the wing plane.

7. The earphone assembly of claim 5, further comprising a nozzle member extending from the housing along a sound axis and defining the audio port such that the audio port directs sound emitted by the speaker out from the earphone assembly along the sound axis, wherein the wing plane forms a sound wing angle with the sound axis in a range between 57° and 97°.

8. The earphone assembly of claim 1, wherein a portion of the deformable wing is operative to be positioned under an anti-helix crus of the user's ear when the earphone assembly is worn by the user's ear.

9. An earbud comprising:

a housing having an audio port;

a speaker disposed within the housing and aligned to emit sound through the audio port;

a sheath coupled to the housing;

a deformable wing sized and shaped to anchor the earbud to a user's ear and having first and second ends coupled to first and second anchoring locations, respectively, on the sheath; and a first flex arm body positioned within the deformable wing and extending from the first anchoring location and terminating at a location between the first and second ends, and a second flex arm body positioned within the deformable wing and extending from the second anchoring location and terminating at a location between a distal end of the first flex arm body and the second end;

wherein the first flex arm body has a length that is at least twice as long as a length of the second flex arm body, the first and second flex arm bodies have a constant width and thickness along at least a majority of their lengths, a material of the first and second flex arm bodies is more rigid than a material of the deformable wing, and the first and second flex arm bodies provide greater resistance when the deformable wing is bent in a first direction than when the deformable wing is bent in a second direction different than the first direction.

10. The earbud set forth in claim 9 wherein the sheath encases the housing and defines outer surfaces of the deformable wing.

11. The earbud set forth in claim 9 wherein a length of the deformable wing between the first and second ends forms a loop with the housing.

12. An earbud comprising:

a housing having an audio port;

a speaker disposed within the housing and aligned to emit sound through the audio port;

a sheath removably coupled to the housing;

a deformable wing sized and shaped to engage an anti-helix portion of a user's ear thereby anchoring the earbud to the user's ear, the deformable wing having first and second ends coupled to first and second anchoring locations, respectively, on the sheath;

a first flex arm body positioned within the deformable wing and extending from the first anchoring location and terminating at a location between the first and second ends; and a second flex arm body positioned within the deformable wing and extending from the second anchoring location and terminating at a location between a distal end of the first flex arm body and the second end wherein the first flex arm body has a length that is at least twice as long as a length of the second flex arm body and wherein a material of the first and second flex arm bodies is more rigid than a material of the deformable wing and the first and second flex arm bodies provide greater resistance when the wing is bent in a first direction than when the wing is bent in a second direction different than the first direction.

13. The earbud set forth in claim 12 wherein the sheath encases the housing and defines outer surfaces of the deformable wing.

14. The earbud set forth in claim 12 wherein a length of the deformable wing between the first and second ends forms a loop with the housing.

* * * * *